US007303304B2

(12) United States Patent
Gharabegian

(10) Patent No.: US 7,303,304 B2
(45) **Date of Patent: *Dec. 4, 2007**

(54) VIEW AND GLOW SEATING

(75) Inventor: Armen Sevada Gharabegian, Glendale, CA (US)

(73) Assignee: Ethos Design, Glendale, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/491,609

(22) Filed: Jul. 24, 2006

(65) Prior Publication Data

US 2006/0256527 A1 Nov. 16, 2006

Related U.S. Application Data

(63) Continuation of application No. 10/973,905, filed on Oct. 25, 2004, now Pat. No. 7,080,919.

(51) Int. Cl.
*F21V 33/00* (2006.01)

(52) U.S. Cl. ..... 362/131; 362/253; 362/234; 297/217.6; 297/452.41

(58) Field of Classification Search ..... 362/127, 362/131, 253, 294, 373, 234, 483, 96; 353/57, 353/61; 297/217.6, 452.41, DIG. 3, 188.04
See application file for complete search history.

(56) References Cited

U.S. PATENT DOCUMENTS

| | | | | |
|---|---|---|---|---|
| 192,770 | A | 7/1877 | Lacomme et al. | 40/320 |
| 1,639,085 | A | 8/1927 | Fohey | 297/188.04 |
| 2,635,681 | A | 4/1953 | Hiltman | 297/217.6 |
| 3,506,820 | A | 4/1970 | Shannon | 362/131 |
| 4,217,628 | A | 8/1980 | Windom | 362/483 |
| 5,107,637 | A | 4/1992 | Robbins | 52/28 |
| 5,329,716 | A | 7/1994 | Fite | 40/575 |
| 5,685,029 | A | 11/1997 | Gee | 4/483 |
| 5,709,448 | A | 1/1998 | Jennings et al. | 362/581 |
| 5,918,932 | A | 7/1999 | Morrison et al. | 297/217.6 |
| 6,126,233 | A | 10/2000 | Gaetano et al. | 297/217.6 |
| 6,149,489 | A | 11/2000 | Johnson | 446/227 |

(Continued)

FOREIGN PATENT DOCUMENTS

DE 299 03 776 U1 7/1999

(Continued)

OTHER PUBLICATIONS

Lighting Fair, What's New in Lighting Technology and Design,: LED desk and chair:, Oct. 29, 2004, retrieved from http:www.archive.org/web/20041029214310/http://web.shopbiz.jp/contents/news_LF/50_015.phtml, XP-002403096.

(Continued)

*Primary Examiner*—Thomas M. Sember
(74) *Attorney, Agent, or Firm*—Pillsbury Winthrop Shaw Pittman LLP

(57) ABSTRACT

Seating structures having (1) an internal image projector for projecting images on the exterior surface of such seating structures and (2) an internal source of illumination with color changing capability, the effect of which is visible on the exterior surface of the seating structures are disclosed. The image projection technology is powered by a standard AC outlet and operated by remote control. The illumination technology is powered by either an AC outlet or battery and is operated by remote control. An internal or external DVD or other data source may be incorporated for image projection.

27 Claims, 1 Drawing Sheet

U.S. PATENT DOCUMENTS

| | | | | |
|---|---|---|---|---|
| 6,164,787 | A | 12/2000 | Seki et al. | 362/1 |
| 6,199,999 | B1 | 3/2001 | Cotton, Jr. | 362/131 |
| 6,459,919 | B1 | 10/2002 | Lys et al. | 600/407 |
| 6,604,309 | B1 | 8/2003 | Phua | 40/560 |
| 6,854,869 | B1 | 2/2005 | Fernandez | 362/488 |
| 6,871,696 | B2 | 3/2005 | Aoki et al. | 165/43 |
| 7,008,020 | B2 * | 3/2006 | Becker et al. | 297/452.41 |
| 2005/0201080 | A1 | 9/2005 | Seward | 362/97 |

FOREIGN PATENT DOCUMENTS

| | | |
|---|---|---|
| DE | 299 03 780 U1 | 7/1999 |
| DE | 299 03 057 U1 | 7/2000 |
| JP | 62 055691 | 3/1987 |
| JP | 2000-254041 | 9/2000 |

OTHER PUBLICATIONS

B9 Design Llc, Corona Chair and Loveseat, XP-002403097, Feb. 4, 2005, retrieved from http://web.archive.org/web/20050204141617/http"//www.b9furniture.com/Newfiles/Corona.html.

European Search Report,, dated Nov. 11, 2006, for corresponding European application.

* cited by examiner

VIEW AND GLOW SEATING

RELATED APPLICATIONS

This application is a continuation application of U.S. application Ser. No. 10/973,905, filed Oct. 25, 2004, now U.S. Pat. No. 7,080,919.

BACKGROUND

1. Technical Field

Embodiments described herein are directed to seating structures that incorporate an internal image projection and an internal source of illumination.

2. Related Art

Many professionals such as, for example, event planners, exhibitors, hospitality professionals, and retail designers, employ furniture-rental as a key business activity. A lack of unique, high-quality designs available in the furniture-rental market causes industry professionals to reuse the same rental items, miss the opportunity to differentiate themselves from their competitors, and disappoint their clients by producing stale results. The embodiments described herein aim to compensate for the lack of outstanding, inventive, and unique furniture design currently available in the marketplace.

SUMMARY OF TECHNICAL FIELD

Embodiments described herein aim to compensate for the dearth of superior and distinctive furniture design currently available in the stream of commerce. The principle object of the present invention is to incorporate non-traditional visual stimuli into the design of seating structures such as, for example, chairs, sofas, and ottomans. Another object of this invention is to incorporate an internal source of projected images visible on the exterior surface of such seating structures ("VIEW"). An additional object of the present invention is to incorporate an internal source of illumination, with color changing capability, the effect of which is visible on the exterior surface of the seating structures ("GLOW").

The seating surfaces of the present invention feature internally housed projection or illumination technologies. For illustration purposes, the upholstered surface of the seating may include a rigid or flexible, semi-opaque material, to maximize the VIEW or GLOW effects.

VIEW technologies may be powered by a standard AC outlet and be operated by remote control. The GLOW technologies may be powered by either an AC outlet or battery and be operated by remote control. An internal or external DVD or other data source may be incorporated into the invention to enable the VIEW technology.

The housing of the projection source within the seating is engineered for maximum image throw and quality. The internal construction of the seat, along with the selection of materials for the seat-back, function in concert to achieve a high-quality projected image and to maintain comfortable sitting conditions. The housing of the internal light source, along with the interior construction of the seating and selection of materials for the seat cushion and seat-back, function in concert to achieve a high-impact lighting effect. A feature of the invention includes the application of mini-coolant fans mounted in the back or bottom panel of the seating, the purpose of which is to maintain a low temperature within the interior of the seating surface. The foregoing objects, features, and advantages, as well as others, will become more apparent in light of the following detailed description read with reference to the drawing.

BRIEF DESCRIPTION OF THE DRAWING

A detailed description of embodiments of the invention will be made with reference to the accompanying drawing.

DETAILED DESCRIPTION

Figure 1:
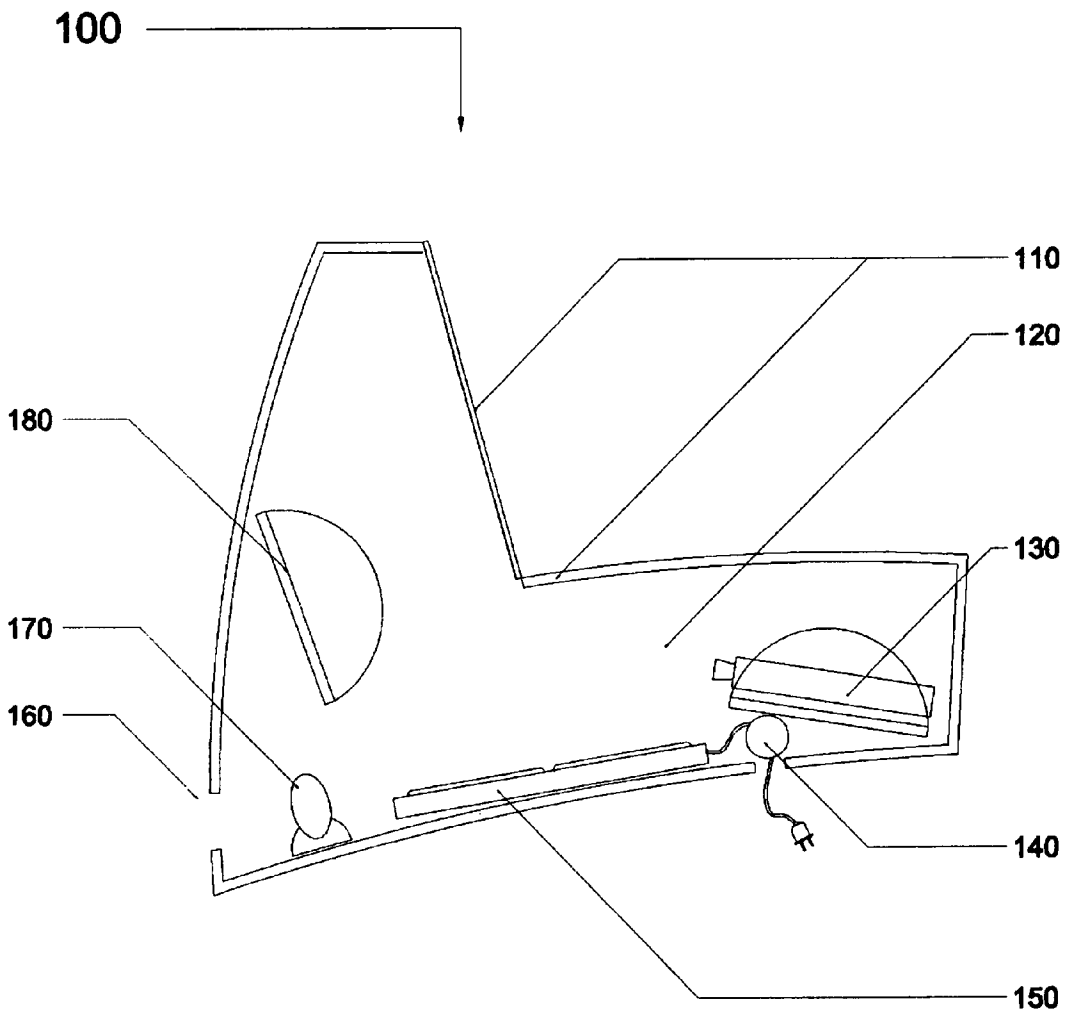
FIG. 1 is a perspective view of a seating structure having an internal image projector and an internal source of illumination, according to an embodiment of the present invention.

The following paragraphs describe view and glow seating structures that incorporate an internal image projection and an internal source of illumination. The seating structures incorporate a moving or a static image via projection. In addition, the seating structures have an internal source of illumination that allows the exterior surface of the seating structures to glow. Referring to FIG. 1, a seating structure 100 is shown. The seating structure 100 is primarily used for sitting, lounging, and resting. The seating structure 100 may be a sofa, sofa bed, chair, ottoman, chaise longue, recliner, dining chair, cushion, pillow, or an inflatable for outdoor use, for example. The seating structure 100 may be air-pressured or vacuum-formed amorphous shapes. Furthermore, the seating structure 100 may have one or more seats.

The seating structure 100 does not have to conform to a normative furniture function. The seating structure 100 can instead be a series of soft glowing spheres on a horizontal surface or multiple cubes, rectangles, or pillows, for example, arranged in a specific pattern, with a design intent, or with the intention of creating some form of lounge, seating, sleeping, or resting surface or surfaces that can be joined together.

The seating structure 100 may be constructed of various materials but is not limited to a substructure or an internal structure. Internal structures may be constructed of different types of wood, plywood, high density wood, and fibrous wood of various types. The seating structure 100 may be constructed of steel, aluminum, brass, or copper, for example. The seating structure 100 may further be cast in various materials such as plastic, acrylic, or corrugated acrylics such as polygal, for example.

The seating structure 100 consists of a light penetrable surface 110 that captures projection output or illumination. Examples of such light penetrable surfaces 110 that capture projection output include, but are not limited to, acrylic, plastic, and fabric. Examples of such light penetrable surfaces 110 that capture illumination include, but are not limited to, translucent foam, translucent rubber, and inflatables. Indeed, the light penetrable surface 110 may be any material through which images and light can pass. The light penetrable surface 110 of the seating structure 100 can be soft or hard. Moreover, the light penetrable surface 110 can be various types of rubber, neoprene, lexan, vinyl, polypropylene, polyurethane, or latex—all in various degrees of density. The light penetrable surface 110 of the seating structure 100 may further be created using injection molded plastics, cast acrylic, and fiber glass, which can be semi-translucent or transparent.

The seating structure 100 need not be horizontal. Instead, it can have angles, be skewed, flat, concave, or convex. The same holds true for the seat-back, provided that the seating structure 100 has such a seat-back. The seating structure 100 can be comprised of many glowing pieces, such as for example, balls of light or cubes of light that may be soft or hard. The seating structure 100 may have pillows that are inflated or are filled with foam or other type of substrate or fibrous materials such as polyester. Pellets of foam, rubber pellets, and transparent or translucent tubes, all of which may glow, may be included in the seating structure 100. Moreover, the light penetrable surface 110 of the seating structure 100 can be constructed with the use of fiber optic lights or a type of fabric that inherently glows.

The light penetrable surface 110 of the seating structure 100 may have fabric attached to an inflatable, stretch fabric, such as for example, lycra, textured fabrics, foam with no fabric, fiber glass, or rubber of various types and densities, such as latex, a stretchable rubber. Semi-opaque foam or acrylic may be used as well.

Inside the seating structure 100 is a chamber 120 that houses a projection mechanism 130, such as but not limited to a single projector, multiple projectors, image sources such as mirrors or prisms, and various types of light instruments that are capable of throwing images and patterns. The projection mechanism 130 may be mounted with a bracket to allow for adjusting the resulting projection angle. Projection may occur in one area of the seating structure 100 or in various areas such as, for example, horizontal and vertical surfaces including, but not limited to, the seat, the seat-back, and inside pillows.

A retractable cable 140 is used for plugging the seating structure 100 into an AC electrical outlet. The retractable cable 140 provides the added benefit of moving the seating structure 100 in various positions throughout a room while only displaying as much of the cord of the retractable cable 140 as necessary. In an alternative embodiment, the seating structure 100 may also be battery operated.

The seating structure 100 has an internal mechanism that affects a glow using various types of light sources 150 such as but not limited to different types of fluorescent lights, different types of incandescent lights, white light emitting diodes ("LEDs"), colored LEDs, LEDs that have color changing capabilities through remote control, tube lights, xenon lights, phosphorous tubes of light through chemical reaction, fiber optics, strobe lights, image projectors, or moving light sources that cause the light objects to glow. Light stemming from within the seating structure 100, through the seating structure 100, or as inherently being a part of the fiber of the seating structure 100, may change color via various types of manipulation such as different colored light bulbs, color changing light sources, color changing light bulbs, light gels, glass gobos, or transparencies, such as slides.

A feature of the invention includes the application of one or more mini-coolant fans 170 mounted in the back or bottom panel of the seating structure 100. The mini-coolant fans 170 maintain a low temperature within the interior of the seating structure 100 and generate the circulation of air. Ventilation 160 is provided to enable the air circulation from the mini-coolant fans 170.

The interior of the seating structure 100 incorporates a reflective surface 180 that captures images from the projection mechanism 130 and projects such images to a desired surface. The reflective surface 180 aids in magnification and correction of image sources such as mirrors, prisms, or other materials, including but not limited to clear acetate or reflective acetate. Internal or external cameras are used to record and playback real time movement with respect to the image projection.

The seating structure 100 may further house an audio source incorporated within the glowing function. In addition, the seating structure 100 may have an external light source or be designed within channels to emit light onto the seating structure. An audio-video source may further be housed within the seating structure 100. DVD players, laptop computers, or an Internet source of image projection may be included. Finally, the seating structure 100 may also have an external source for projection such as a DVD player. The seating structure 100 may operate with a remote control.

While the above description refers to particular embodiments of the present invention, it will be understood to those of ordinary skill in the art that modifications may be made without departing from the spirit thereof. The accompanying claims are intended to cover any such modifications as would fall within the true scope and spirit of the present invention.

The presently disclosed embodiments are therefore to be considered in all respects as illustrative and not restrictive; the scope of the invention being indicated by the appended claims, rather than the foregoing description. All changes that come within the meaning and range of equivalency of the claims are therefore intended to be embraced therein.

What is claimed is:

1. A seating structure of internal image projection, comprising:

a projector housed within a chamber of the seating structure that generates images; and a light penetrable outer surface covering the seating structure to capture and display the images generated from the projector.

2. The seating structure of claim 1, further including a DVD player to generate the images for the projector.

3. The seating structure of claim 1, further including a laptop computer to generate the images for the projector.

4. The seating structure of claim 1, further including an Internet source of image projection to generate the images for the projector.

5. A seating structure of internal image projection, comprising:

a projector housed within a chamber of the seating structure to generate images;

a light penetrable outer surface covering the seating structure; and a reflective surface, within the seating structure, that captures the images generated by the projector and reflects the captured images to a designated area of the light penetrable outer surface.

6. The seating structure of claim 5, wherein the designated area is the seat.

7. The seating structure of claim 5, wherein the projector is mounted on a bracket to allow for adjusting a projection angle of the generated images.

8. The seating structure of claim 5, wherein the images are moving images.

9. The seating structure of claim 5, further including a DVD player to generate the images for the projector.

10. The seating structure of claim 5, further including a laptop computer to generate the images for the projector.

11. The seating structure of claim 5, further including an Internet source of image projection to generate the images for the projector.

12. A seating structure of internal illumination, comprising:

a light source housed within a chamber of the seating structure to generate light; and a light penetrable outer surface covering the seating structure to capture the light and produce a glowing effect over an entire surface of the light penetrable outer surface.

13. The seating structure of claim 12, further including internal structures to provide support for the seating structure.

14. The seating structure of claim 13, wherein the internal structure is made of one of a group of materials, the group of materials including one of a group of wood, plywood, high density wood, steel, aluminum, brass, and copper.

15. The seating structure of claim 13, wherein the internal structure is made of a group including one of the following materials: plastic, acrylic, or corrugated acrylic.

16. The seating structure of claim 12, wherein the light penetrable outer surface is made of one of a group of materials, the group of materials including acrylic, plastic, fabric, translucent foam, translucent rubber, injection molded plastics, cast acrylics, and fiber glass.

17. The seating structure of claim 12, wherein the light penetrable surface is constructed of a fabric that inherently glows.

18. The seating structure of claim 12, wherein the light source is one of a group of lights, the group of lights including fluorescent lights, incandescent lights, white light emitting diodes, colored LEDs, tube lights, xenon lights, phosphorous tubes of light through chemical reaction, fiber optics, strobe lights.

19. The seating structure of claim 12, wherein the light source can change colors.

20. The seating structure of claim 19, wherein the light source changes color through one of a group of techniques, the group of techniques including different colored light bulbs, color changing light sources, color changing light bulbs, light gels, glass gobos, or slide transparencies.

21. A seating structure of internal illumination, comprising:

a light source housed within a chamber of the seating structure to generate light; and a light penetrable outer surface covering the seating structure to capture the light and produce a glowing effect over the light penetrable outer surface, wherein the light penetrable surface is constructed using fiber optic lights.

22. An inflatable seating structure, comprising:

a light source housed within an interior of the inflatable seating structure to generate light; and a light penetrable outer surface covering the seating structure to receive the light and to produce a glowing effect over an entire surface of the light penetrable outer surface.

23. The inflatable seating structure of claim 22, further including a fabric attached to the inflatable.

24. The inflatable seating structure of claim 23, wherein the fabric is one of a group of lycra, textured fabrics, foam, fiber glass, rubber, semi-opaque foam, or acrylic.

25. An amorphous shaped seating structure, comprising:

a light source housed within an interior of the amorphous-shaped seating structure to generate light; and a light penetrable outer surface covering the amorphous-shaped seating structure to receive the light and to produce a glowing effect over an entire surface of the light penetrable outer surface.

26. The amorphous shaped seating structure of claim 25, wherein the seating structure is air-filled to maintain the amorphous shape.

27. The amorphous shaped seating structure of claim 25, wherein the seating structure is vacuum-formed to maintain the amorphous shape.

* * * * *